United States Patent [19]

Kraft

[11] 4,212,460

[45] Jul. 15, 1980

[54] HOLLOW WATER-FILLED GAME TOY

[76] Inventor: Donald J. Kraft, 512 Dartmouth Rd., Burbank, Calif. 91510

[21] Appl. No.: 928,382

[22] Filed: Jul. 27, 1978

[51] Int. Cl.[2] ..... A63B 37/12; A63B 43/04

[52] U.S. Cl. ..... 273/58 B; 273/58 H; 273/127 A; 46/17; 273/317; 273/428

[58] Field of Search ..... 273/58 B, 58 H, 58 K, 273/58 A, 58 BA, 127 A, 58 F, 128 A, 106 E; 46/91, 17

[56] References Cited

U.S. PATENT DOCUMENTS

| | | | |
|---|---|---|---|
| 2,091,684 | 8/1937 | Mabee | 273/58 B |
| 2,645,486 | 7/1953 | Monahan | 273/58 K X |
| 2,939,246 | 6/1960 | Glos | 273/58 B X |
| 3,687,452 | 8/1972 | Thompson | 273/58 B X |
| 3,740,036 | 6/1973 | Ames | 273/58 A X |

*Primary Examiner*—George J. Marlo

*Attorney, Agent, or Firm*—Kenneth J. Hovet

[57] ABSTRACT

A hollow body is provided having two complementary parts releasably joined about interfitting rim portions. When the parts are joined, the hollow body may be compressed to partially deform a portion of the rim structure into an opening thereby allowing the filling of water into the body interior. After deformation the parts resume their original shape. An effective hermetic seal to retain the water within the interior is formed by squeezing the body and purging air through vents in the rim portions. The water-filled body may then be thrown against a stationary object whereby the force of impact will release the seal and allow the water to become suddenly released causing a splashing action. The complementary hollow parts may be subsequently rejoined and refilled with water to repeat the throwing and splashing action.

7 Claims, 11 Drawing Figures

HOLLOW WATER-FILLED GAME TOY

BACKGROUND OF THE INVENTION

1. Field of the Invention

The present invention relates to water-filled game toys and, more particularly, to a resealable two-part hollow body filled with water.

2. Description of the Prior Art

Various ball games are known in the prior art which allow for a splitting into separate parts upon impact. Such devices may have a latching mechanism contained within the ball halves which, when impacted, will unlatch allowing the halves to split apart. Such a split ball device is shown and described in U.S. Pat. No. 3,687,452.

Another ball game which is constructed of multiple interconnecting parts is shown in U.S. Pat. No. 3,740,036. The ball disclosed in this patent provides that the assembled parts of the ball will progressively disintegrate when thrown or rolled in a particular manner due to the particular geometrical configuration of the interfitting parts.

Insofar as water-filled toys are concerned, U.S. Pat. No. 2,645,486 discloses a transparent ball partially filled with water containing a floating card. Each ball half is glued together and the card is permanently sealed therein. Probably the best known prior art, however, is the rubber balloon filled with water. Such balloons are typically thrown and the force of water upon impact ruptures the balloon creating a vivid splashing action. The disadvantages of such balloons is their cumbersome handling and throwing characteristics and their inability to be reused.

SUMMARY OF THE INVENTION

It will be appreciated that the present invention provides complementary resilient hollow parts which have matching rim structures which are self-centering and adapted to form a substantially water-tight seal. Due to the resilience of the hollow parts, the rim structure may be deformed to create an opening therein to allow for the filling of water. Upon allowing the parts to return to their original shape, the rim structure becomes completely sealed to form a water-filled hollow body which can be thrown against another object. Upon impact the force of the throw will cause the parts to open and allow the water to suddenly escape in a striking display.

DESCRIPTION OF THE PREFERRED EMBODIMENTS

Figure 1:
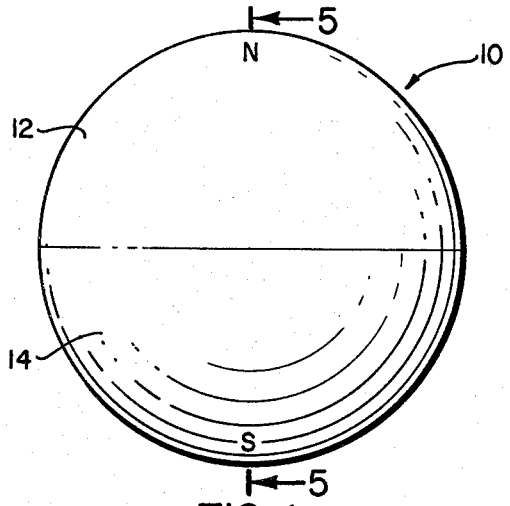
FIG. 1 is a view of a spherical embodiment of the assembled hollow game toy of the present invention.
Figure 2:
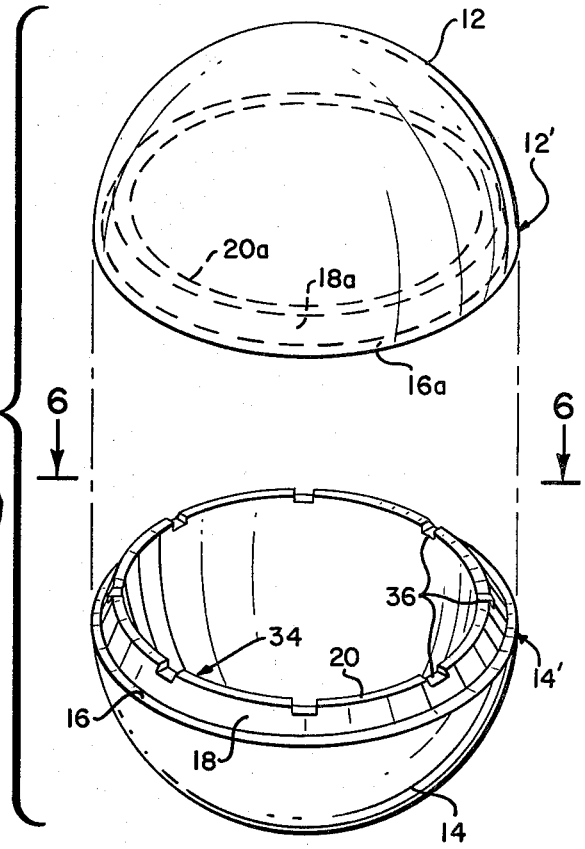
FIG. 2 is an exploded perspective view showing two complementary halves of the toy shown in FIG. 1.

Referring now to the drawings and, more particularly, to FIGS. 1 and 2 thereof, a spherical hollow game toy or ball is shown generally by reference numeral 10. The ball is formed by two complementary hollow parts shown by reference numerals 12 and 14. Each of the complementary hollow parts have matching rim structure shown as 12' and 14'. In the embodiment shown in FIGS. 2–7, a beveled lap joint configuration is depicted. The rim structure **14*a* presents an annular flat shoulder portion 16 extending inwardly from the ball exterior surface to an inwardly inclined wall portion 18. The inclined wall merges into an annular flat top edge portion 20** which extends to the interior surface of the ball.

The hollow part 12 is provided with corresponding surfaces complementary to rim **14*a* comprising a flat annular shoulder portion 16*a* having a width about equal to the width of shoulder portion 16 of part 14. The shoulder portion extends into an inwardly inclined wall portion 18*a* which merges into an inner flat annular top edge 20*a*. It will be understood that the widths of top edges 20 and 20*a* are about equal and the angle of inclination of wall portion 18 and wall portion 18*a*** are complementary angles such that contact is made substantially throughout the overall rim structure. In this manner a seal is formed that will retain water within the ball interior.

The rim structure forming the inner lip portion 34 is provided with at least one or more evacuation vents to allow for the purging of air from the interior of the game toy body when enclosed. In the embodiments shown in FIGS. 2–8, the vents comprise a plurality of spaced-apart indentations 36 in top edge 20. The manner of operating the evacuation vents will be described in more detail hereinafter.

It wil be appreciated that since the vents 36 are for air form the interior of the hollow body, they must have communication with the ball interior. In all the embodiments shown, the vents take the form of transversely extending channels formed across at least a major portion of the rim structure having an open end 38 at the body interior surface. Of course, the vent should not extend across the entire rim structure because such would obviate an effective hermetic seal. Generally, it is convenient for the outer lip structure shown by reference numeral 44 to be free of any grooves or the like.

Figure 9:
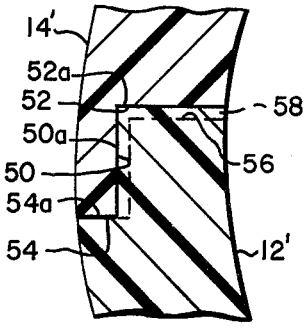
FIG. 9 is an enlarged fragmentary cross-section of a modified lap joint.
Figure 10:
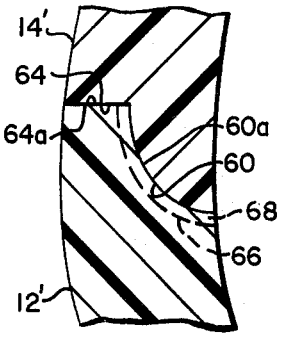
FIG. 10 is an enlarged fragmentary cross-section illustrating a further modified lap joint.

Alternative lap joint rim structures are shown in FIGS. 9 and 10. In particular, FIG. 9 shows matching perpendicular wall portions 50 and **50*a* interconnecting upper and lower flat annular shoulder portions 52, 52*a* and 54 and 54*a*, which interconnect the body shell interior and exterior, respectively. At least one evacuation vent channel 56 is shown in phantom in part 12 extending from interior opening 58 to the junction of wall 50 and shoulder 54. In this manner the complementary annular shoulder portions 54 and 54*a* will remain continuous to form an effective seal. FIG. 10 illustrates arcuate matching wall portions 60 and 60*a* which terminate at outer annular flat sealing surfaces 64, 64*a*, respectively. The arcuate wall 60 is provided at least one channel 66 shown in phantom extending transversely from body interior opening 68 to annular sealing surface 64**.

Figure 11:
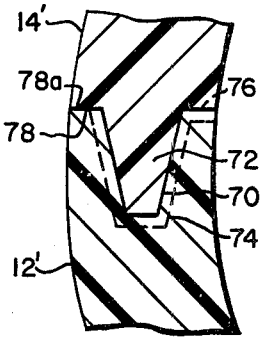
FIG. 11 is a fragmentary enlarged cross-section showing a further modified rim structure showing a tongue and groove joint.

Another alternative rim structure is the tongue and groove joint shown in FIG. 11. In this joint a groove 70 is formed in and around a top edge of the rim structure of part 12. A corresponding annular projection is formed to extend concentrically from around the rim of part 14. When engaged, the tongue and groove joint provides additional surface area for effecting an especially strong seal in the case where the hollow body side walls are thick but soft or limp making an effective seal more difficult. As to the case of the previous joints, a transversely extending channel 74 is formed across the major portion of the rim structure having an opening 76 at the interior surface of the hollow body. In this way, an annular seal will still be formed at the flat annular mating surfaces 78, **78*a*** formed adjacent the body exterior surface.

Figure 3:
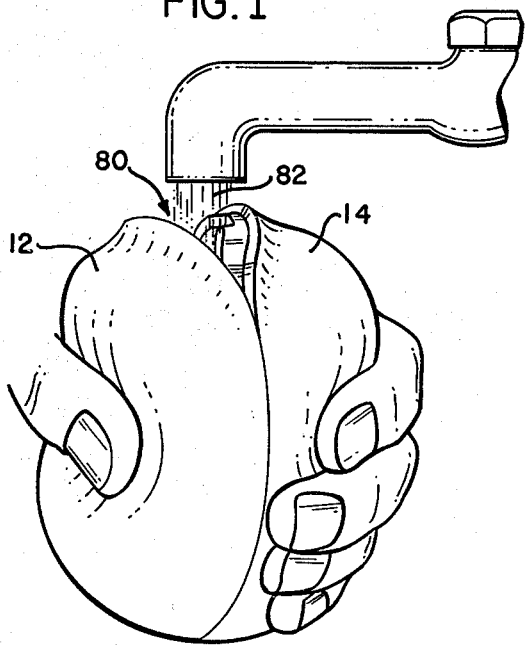
FIG. 3 illustrates the manipulation of the complementary halves of FIG. 2 to open a portion of the rim structure allowing for the filling of the toy interior with water.

To describe the operation of the hollow game toy of the invention, reference will be made to north and south poles of the spherical embodiment shown in FIG. 1. The north and south poles are shown by reference letters N and S, respectively, and are located where the central axis perpendicular to the plane formed by the rim structure intersects the sphere. As best shown in FIGS. 2 and 3, the complementary hollow parts will be frictionally engaged about their respective rim structures 12' and 14' forming a substantially hermetically sealed hollow body. The body is subsequently manually squeezed or compressed with mild force furthermost from the circumferential seal line at opposing sides generally proximate points N and S. When the hollow parts are so compressed, a portion of the rim structure of each hollow part will be puckered outwardly creating a slight opening shown by reference numeral 80. While maintaining such an opening, tap water 82 or other flowable material such as powder or the like may be directed into the interior of the hollow body until the volume thereof is substantially full, i.e., until water overflows the opening 80. When such occurs, the opposing manual pressure is released thereby allowing the deformed rim structure to return to its original shape to form a complete reseal about the engaged rim structure. To further enhance an effective seal, it is appropriate to again depress the areas proximate points N and S to a point where all remaining air and a slight amount of water will be expelled through the aformentioned evacuation vents. Upon release of the compressive pressure, a seal will be immediately reformed due to the resilience of the hollow parts. It will be noted, however, that upon release of the compressive pressure, a vacuum will be formed in the body interior due to the inability of ambient air to refill the volume of water previously expelled. In this manner a more effective seal will be created caused by the ambient atmospheric pressure operating against the external body surfaces and the outer lip structure forcing it in an increasingly tight manner against the matching surfaces of the various inner lip surfaces.

Figure 4:
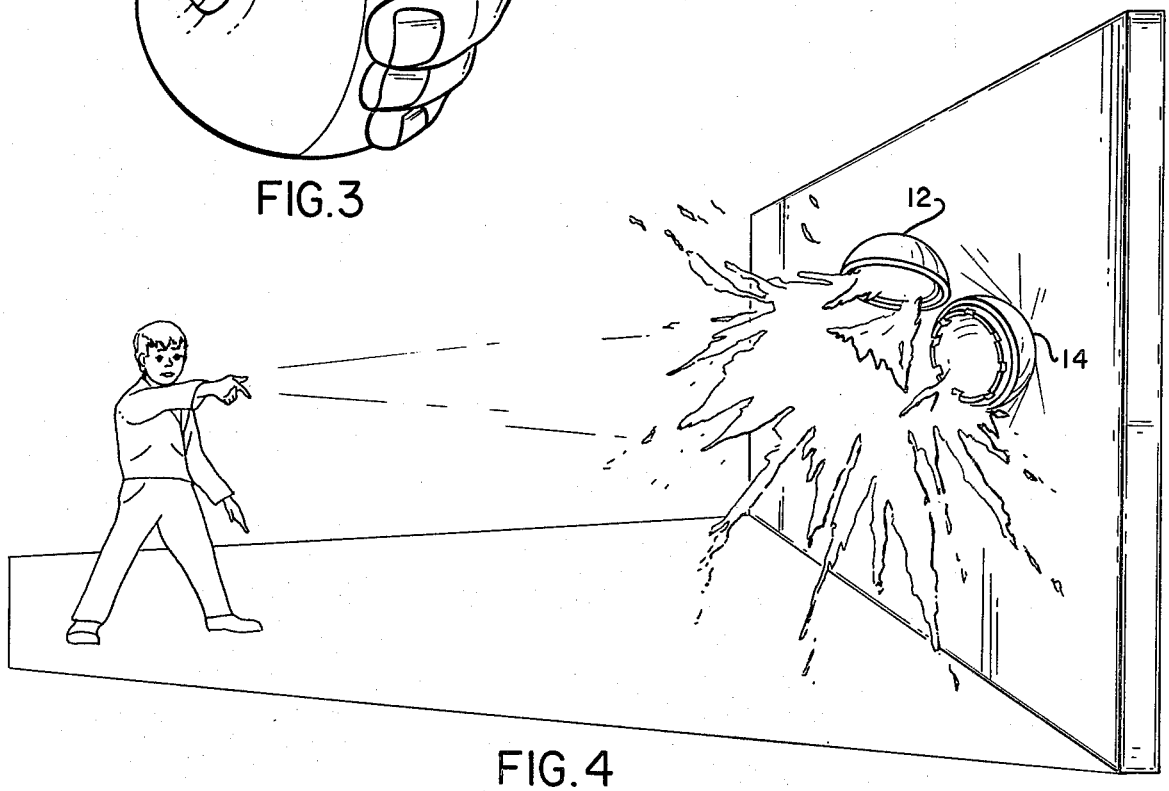
FIG. 4 illustrates the throwing, impact and splashing of water upon the complementary halves of FIG. 2 breaking open during impact.
Figure 5:
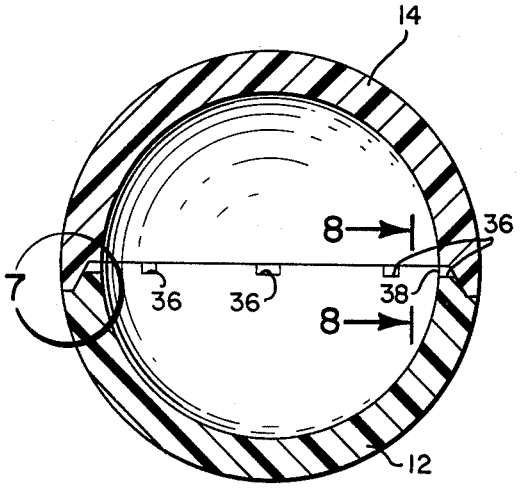
FIG. 5 is a cross-section taken along lines 5—5 of FIG. 1.
Figure 6:
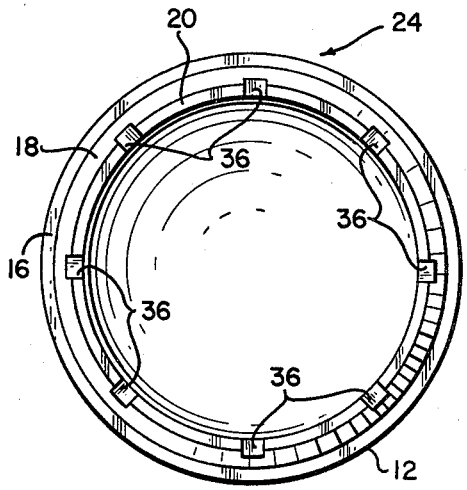
FIG. 6 is a view taken along lines 6—6 of FIG. 2.
Figure 7:
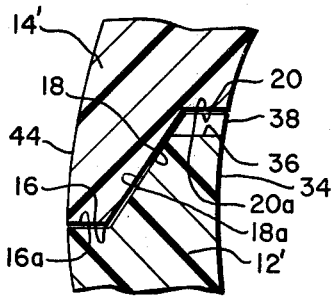
FIG. 7 is an enlarged fragmentary view taken along line 7 of FIG. 5.
Figure 8:
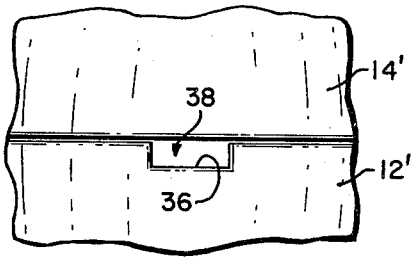
FIG. 8 is a view taken along lines 8—8 of FIG. 5.

After completing the vacuum forming step, the ball is now ready to be thrown against an object. Upon striking the object, as shown in FIG. 4, the force of impact will break the seal about the rim structure and allow the water to splash in an ostentatious manner creating excitement and a vivid impression in a youthful user's mind. The resilient hollow parts may be retrieved and reassembled for refilling of water and the procedure may be repeated again and again. It will be noted that alternative structures may be used in place of the spherical embodiment shown in the drawings. For example, elipsoidal or cylindrical bodies may be utilized depicting toy grenades, toy dynamite, simulated bombs, shell casings, torpedoes. Also various types of athletic balls may be simulated such as baseballs, footballs, tennis balls or the like. In this regard, note that the exterior surfaces may be imprinted, embossed and/or colored to simulate such items.

The hollow body may be constructed of several types of plastic materials such as rubber, organosols, plastisols, vinyl dispersions or thermoplastic molded materials. It is essential that such materials have sufficient resilience to allow the ready deformation of the hollow body parts to create an opening about the rim structure for the filling of fluid materials while having sufficient capability to recover the original shape and retain such during the force of a throw. It will also be appreciated that the hollow parts will have sufficient thickness to enable the formation of an effective sealing area about the rim structure. It is expected that the greater the flexibility of the body material, the greater the body wall thickness that will be needed to effect a proper seal. Rubber-like materials having durometer readings of 25–65 have been effective in carrying out the objectives of the invention.

While the invention has been described with respect to preferred embodiments, it will be apparent to those skilled in the art that other modifications may be made without departing from the spirit and scope of the invention. Accordingly, it is to be understood that the invention is not to be limited by the specific illustrative embodiments hereinabove described but only by the scope of the appended claims.

I claim:

1. A hollow game toy comprising:

two resilient manually deformable complementary parts each having matching rim structures which are engaged to form a substantially hermetically sealed hollow body, said rim structure including at least one evacuation vent for purging fluid from the body interior during deformation of the body.

2. The toy of claim 1 wherein said rim structure comprises an outer offset lip about the rim of one of said parts and an inner offset lip about the rim of the other of said parts forming a lapped joint.

3. The toy of claim 2 wherein said evacuation vent is located on the inner lip of said joint.

4. The toy of claim 3 wherein said evacuation vent comprises a plurality of indentations extending across the top edge of said inner lip.

5. The toy of claim 1 wherein said rim structure comprises a groove formed in and concentrically around the top edge of one of said parts and a corresponding projection extending from and concentrically around the top edge of the other of said parts forming a tongue and groove joint.

6. The toy of claim 2 or 5 wherein said evacuation vent comprises a plurality of channels extending across a major portion of said joint beginning with an opening at the interior surface of said body.

7. The toy of claim 6 wherein the approximate overall shape of said hollow body may be selected from the group consisting of sphere, ovoid, ellipse and cylinder.

* * * * *